United States Patent [19]

Naidus

[11] 3,969,858

[45] July 20, 1976

[54] EXPLOSION VENT CONSTRUCTION

[75] Inventor: Edward Sidney Naidus, Glen Rock, N.J.

[73] Assignee: RCA Corporation, New York, N.Y.

[22] Filed: June 20, 1975

[21] Appl. No.: 588,862

Related U.S. Application Data

[63] Continuation of Ser. No. 458,187, April 5, 1974, abandoned.

[52] U.S. Cl. ..... 52/232; 52/200

[51] Int. Cl.[2] ..... E04B 7/18

[58] Field of Search ..... 52/1, 200, 23, 232; 49/37, 141; 85/8.8

[56] References Cited

UNITED STATES PATENTS

| | | | |
|---|---|---|---|
| 1,132,952 | 3/1915 | Maness | 52/23 |
| 2,610,593 | 9/1952 | Wasserman | 52/200 X |
| 2,918,023 | 12/1959 | Bettcher | 52/200 |
| 3,137,099 | 6/1964 | Wasserman | 52/200 |
| 3,150,749 | 9/1964 | Robrecht et al. | 52/1 |
| 3,340,656 | 9/1967 | Mathien | 52/200 |
| 3,774,364 | 11/1973 | Johnson | 52/23 |
| 3,788,013 | 1/1974 | Veen, Jr. | 52/1 |
| 3,807,421 | 4/1974 | Geiger et al. | 52/23 |

FOREIGN PATENTS OR APPLICATIONS

| | | | |
|---|---|---|---|
| 1,259,251 | 5/1961 | France | 85/8.8 |
| 1,574,137 | 7/1969 | France | 52/200 |

*Primary Examiner*—Ernest R. Purser
*Assistant Examiner*—Leslie A. Braun
*Attorney, Agent, or Firm*—Edward J. Norton; William Squire

[57] ABSTRACT

An explosion vent comprises a symmetrical convex dome disposed over a building roof or wall vent opening. A pair of symmetrically arranged safety braces are disposed over the dome. A pin is disposed in each brace end and inserted in an enlarged opening or guide in a curb assembly which supports the dome on the building adjacent the vent opening. The pins and pin receiving openings or guides are arranged to disengage only when a predetermined pressure differential (an explosion) "pops out" the dome and braces in a predetermined direction determined by the parallel axes of the pins.

2 Claims, 4 Drawing Figures

EXPLOSION VENT CONSTRUCTION

This is a continuation of application Ser. No. 458,187, filed Apr. 5, 1974, now abandoned.

BACKGROUND OF THE INVENTION

The present invention relates to a building construction which provides a pressure relief vent in case of an explosion or sudden increase in pressure within the building. For certain types of building constructions such as factories manufacturing explosive materials (inherent explosives, organic volatiles, dusts) and the like, it is desirable to have explosion relief vents. These vents seal the roof or wall of the building during normal use, but in case of an interior explosion provide a pressure relief vent to relieve the internal pressure within the building to prevent or minimize structural damage to the building. Such a relief vent must ordinarily provide a shield to the building from the ambient weather conditions.

At the same time an explosion occurs within the structure a large pressure differential or shock wave is created, the energy of which can damage a conventional structure. The shock wave energy must be immediately dissipated to preclude structural damage. This requires the vent enclosure member be sufficiently large to provide significant energy dissipation and sufficiently sensitive to the pressure differential to immediately release upon occurrence of the shock wave.

In accordance with many code regulations structures to be used where explosion hazards are likely are required to have explosion vents that release at low pressures preferably under 35 lbs. per sq. ft. Release of the explosion vent should occur preferably without creating secondary damage or hazards. Venting construction also should withstand normal ambient pressure differentials due to winds and the like. These normal differentials, however are within the pressure range, e.g., 10–40 PSF, within the pressure range established as sufficient to damage the structure of a building upon the occurrence of an explosion. Activation at such low pressures is an essential requirement of an explosion venting construction established by insurance underwriters and building code authorities for buildings which use hazardous materials in the normal operations for which the building is constructed. Thus, while many factors may tend to produce a given load on an explosion vent, the vent must only respond to an explosion or a pressure differential capable of causing structural damage to roof, walls or supporting members.

SUMMARY OF THE INVENTION

A building explosion venting apparatus is provided for enclosing an explosion vent opening. The building has a plurality of pin receiving apertures spaced in a predetermined array adjacent the opening. The venting apparatus comprises an enclosure member arranged to enclose the opening when disposed adjacent thereto, a portion of the enclosure member being juxtaposed with the apertures when in the enclosing position. A plurality of elongated pins are secured to the member in a predetermined array for releasable engagement with the apertures to releasably secure the enclosure member to the building. The pins extend from the member in the same given direction. The member has a symmetrical cavity extending in a direction opposite the same direction. The pins have a transverse dimension smaller than the transverse dimension of the apertures such that the pins slideably engage and disengage with the apertures only when the member is translated in the direction parallel to the given direction.

In the drawings:

FIG. 1 is a side elevational view of an explosion vent member constructed in accordance with an embodiment of the present invention, FIG. 2 is a plan view of the vent construction of FIG. 1, FIG. 3 is a sectional elevational view along lines 3—3 of FIG. 2 illustrating detailed construction of the vent member of FIGS. 1 and 2, and FIG. 4 is an end sectional view taken along line 4—4 of FIG. 3.

DETAILED DESCRIPTION

Figure 1:
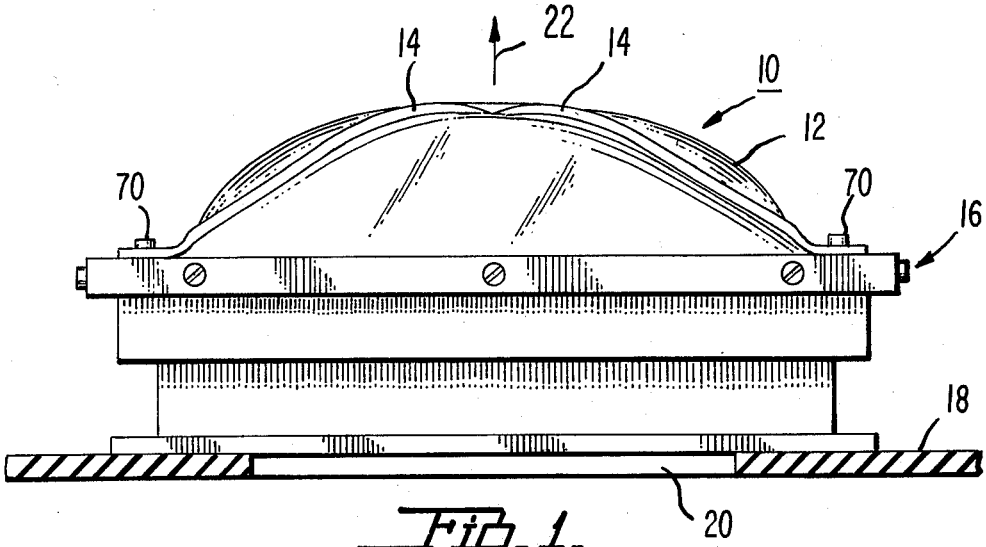

In FIG. 1 explosion venting apparatus 10 includes a thermoplastic dome member 12 and a plurality of personnel safety cross braces 14 mounted on curb assembly 16. Braces 14 prevent personnel from falling through the vent opening 20, member 12 usually being incapable of withstanding such a load. Curb assembly 16 is mounted on a roof 18 or wall of a building having an explosion vent opening 20. Opening 20 is exposed to the interior of the building to be explosion vented. The venting apparatus 10 serves to seal the interior of the building from the exterior ambient. Preferably dome member 12 is made of a translucent or clear material suitable for transmitting light through the vent opening 20 to the interior of the building. Apparatus 10 serves as an explosion venting member should an explosion occur within a building and as a skylight during normal use of the building.

A suitable dome member 12 is one of the type described in copending application entitled BUILDING MEMBER, Ser. No. 431,694, filed Jan. 9, 1974, now U.S. Pat. No. 3,918,226, which is a continuation of Ser. No. 292,092, filed Sept. 25, 1972, now abandoned, and assigned to the assignee of the present invention. The essential characteristic of dome member 12 is that when an explosion occurs within the interior of the building so that an explosive force is directed through vent opening 20, the resultant force on dome member 12 is in direction 22. It is assumed that the shock wave produced by the explosion is normal to the roof or wall. It is essential that the direction of the resultant force on member 12 produced by all of the force components on member 12 by the shock wave be in the same predetermined direction 22. If the resultant force on dome member 12 due to the configuration of the dome member is in a direction that is substantially different from direction 22, then that dome member and accompanying braces remain intact and will not "pop out" in response to the explosion force. This will be explained hereinafter. Therefore, while a particular configuration of the dome member 12 is not important, what is essential is that the configuration be symmetrical with respect to opening 20 to the extent that all of the component forces on the member produce a resultant "pop out" force in direction 22.

Figure 2:
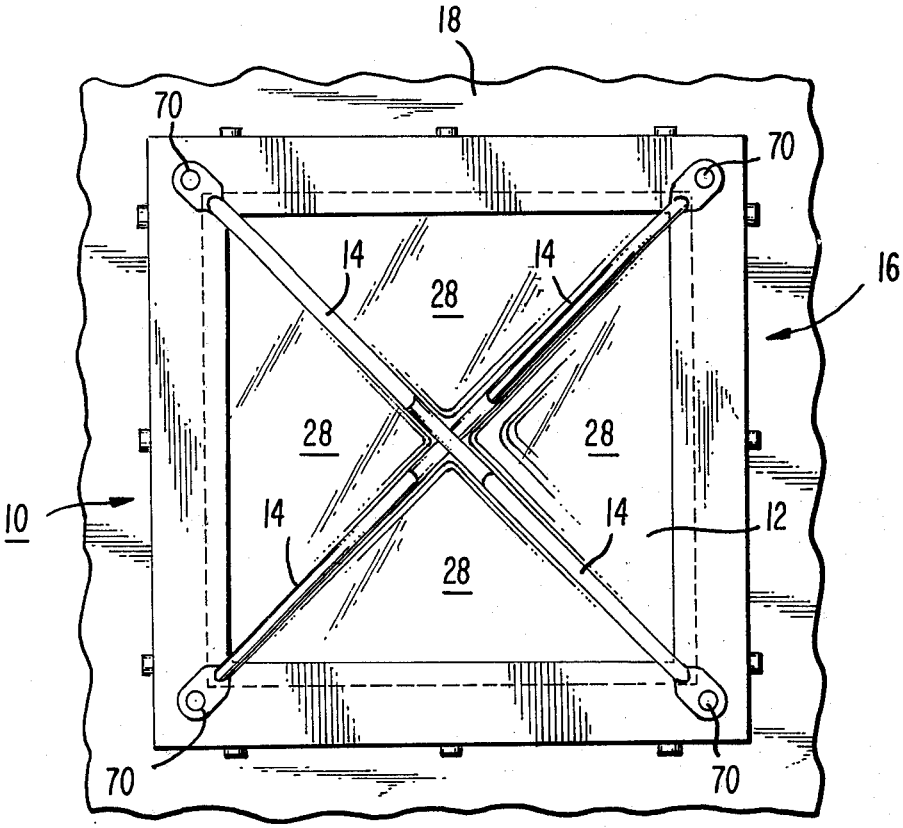
Figure 3:
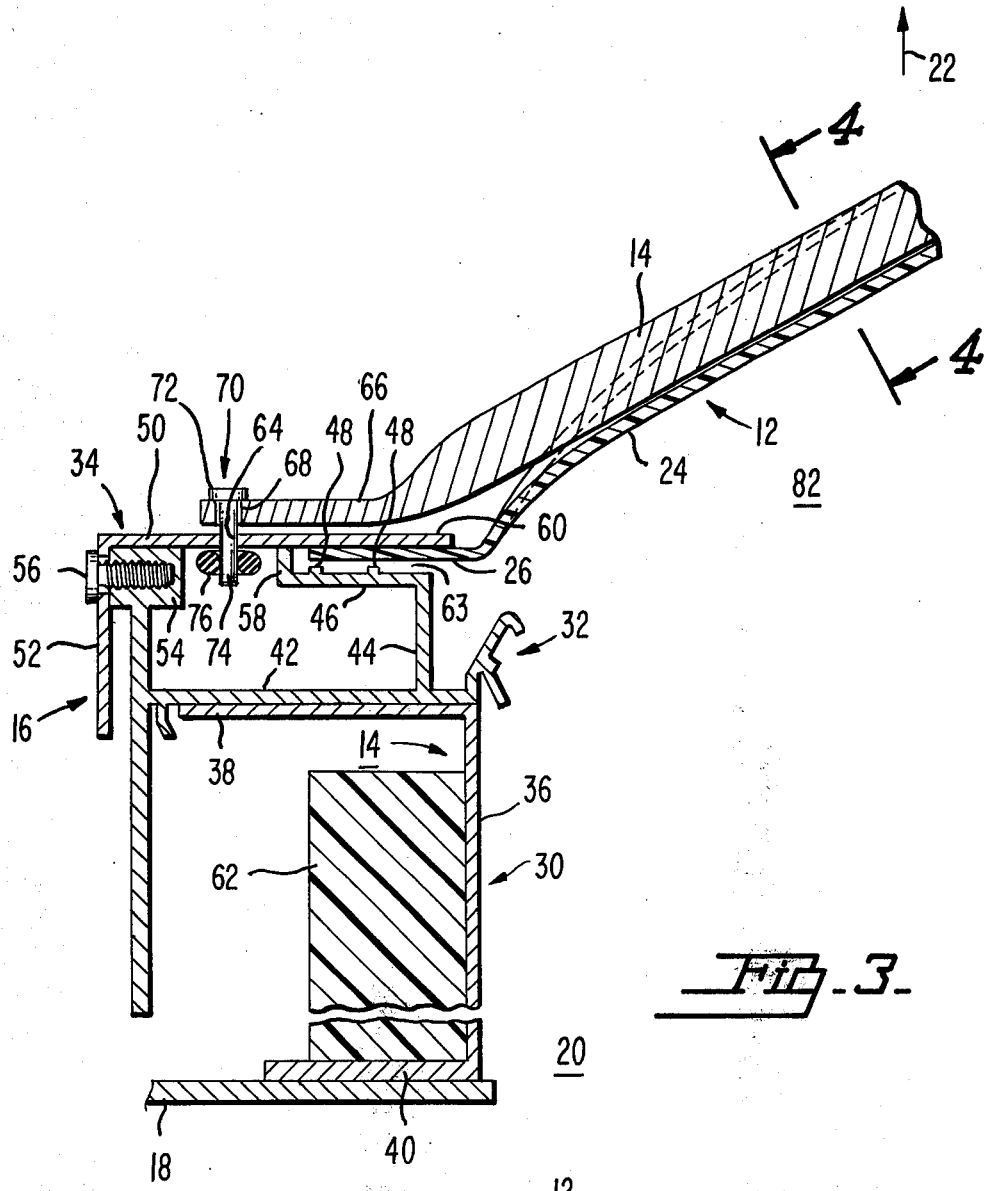

In FIG. 3 there is illustrated an enlarged sectional portion of the curb assembly 16 and the manner in which dome 12 and braces 14 are secured to the roof 18. Dome member 12 comprises a generally convex portion 24 which extends beyond the exterior of the building and a planar peripheral flange portion 26 which depends from the outer periphery of convex portion 24. The details of dome member 12 are further described in the above-noted depending application which is incorporated herein by reference. In particular, dome member 12 comprises four generally spheroidal, triangular sections 28 (see FIG. 2) symmetrically disposed within the square periphery formed by flange portion 26.

Curb assembly 16 comprises a roof mounting support 30, extruded curb member 32 and an outer support member 34. Support 30 and members 32 and 34 are extruded aluminum and extend completely around the square periphery of opening 20. Roof mounting support 30 is generally channel shaped with an upstanding channel base member 36 and a horizontally disposed curb support leg 38 and a roof mounting leg 40, both legs depending horizontally from member 36.

Mounted flush with leg 38 is cross member 42. Depending upwardly from cross member 42 adjacent one end thereof is upstanding wall 44. Depending horizontally outwardly from wall 44 parallel to cross member 42 is outwardly depending member 46. Member 46 includes a pair of elongated projections 48 which run the entire length of curb assembly 16. Extended edges of projections 48 support the lower surface of flange portion 26. Outer support member 34 is L-shaped in cross section, as shown, and has a horizontally inwardly depending leg 50 and a downwardly depending leg 52. Leg 50 mounts on boss 54 which, in turn, depends from cross member 42. A suitable fastening device such as a plurality of screws 56 secures support 34 to boss 54. The extended edge of outwardly depending member 46 has depending therefrom an upstanding wall 58 whose upper edge also serves as a support for leg 50. Outwardly depending member 46, upstanding wall 58, extended inward portion 60 of leg 50 form a horizontally extending channel 63 for receiving flange portion 26. It is to be understood that curb assembly 16 is an elongated assembly that extends around the entire periphery of opening 20 of FIG. 1 as best seen in FIG. 2. Curb assembly 16 members are suitably preformed of aluminum by well known extrusion techniques.

Secured to the outer periphery of upstanding channel base member 36 is suitable insulation 62. A circular pin receiving aperture 64 is disposed in each of the four corners of curb assembly 16 on leg 50. Preferably, curb assembly 16 and opening 20 in roof 18 are radially symmetric in shape, (e.g., square, triangular, regular polygon, circle).

Convex portion 24 of dome 12 depends from curb assembly 16 in the upward direction 22 with respect to curb assembly 16 as shown in FIG. 1. Mounted on the exterior of dome 12 are a pair of crossed braces 14. Braces 14 are preferably extruded tubular pipes whose ends 66 are swaged flat so as to lie against the exposed surface of leg 50 of support member 34. Formed in each of brace ends 66 is an aperture 68. Apertures 64 and 68 are circular holes of about the same diameter. Disposed in each of apertures 64 and 68 are respective pins 70. Pins 70 each comprise an enlarged head portion 72 and a cylindrical shank portion 74. The transverse diameter of shank 74 is smaller than the diameter of apertures 64 and 68. As a result, a pin 70, when extended through apertures 64 and 68, is disposed loosely within these apertures. Preferably pins 70 may be disposed in low-friction guides or grommets such as grommet 76 to prevent premature disengagement in transit or during installation. In the alternative, conventional metal spring clips of the tubular type may be utilized to provide the releaseable friction load on pins 70. Head portion 72 supports pin 70 against end 66 of brace 14. One pin 70 is disposed in each of the apertures 64 and 68 in each end 66 of braces 14. As a result, there are four pins 70 in apparatus 10 as shown in FIG. 2.

The alignment of apertures 64 and 68 in each of the corners of apparatus 10 is substantially parallel. As a result, the elongated axis of each of pins 70, when assembled as shown in FIG. 3, are parallel to each other. Further, the parallel direction of pins 70 longitudinal axis is parallel to direction 22 of the resultant force applied to dome 12 when an explosion occurs within the building interior. This is essential as will be explained. As previously stated, a rubber annular grommet 76 or other suitable releaseable friction device can be disposed on the extended end of shank portion 74 of pin 70 to lightly lock pin 70 to curb assembly 16.

Figure 4:
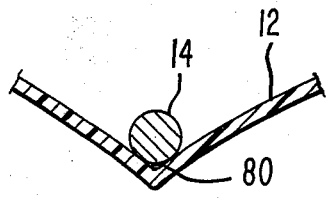

The cross braces 14 preferably are disposed within troughs 80 of dome 12 as shown in FIG. 4. Dome 12 has a plurality of diagonally extending troughs 80 corresponding to each of braces 14 which receive the length of each of braces 14. Braces 14 preferably are welded or otherwise securely fastened to each other at the center of the dome 12.

Extended flange portion 26 and convex portion 24 are sufficiently flexible so that any upwardly directed force in one direction 22 applied against dome 12 will cause bowing of the dome and, thus, flexing of the flange member with respect to the curb assembly 16. This flexure of the flange portion 26 and the bowing of the dome 12 permits the dome 12, in response to an explosion force present in cavity 82, to displace in direction 22. As dome 12 displaces in this direction, the dome bows and flange portion 26 flexes an amount sufficient to permit the dome 12 to "pop out" of channel 63.

In operation, when an explosion occurs within the building interior, an explosive force is present in cavity 82 directly beneath convex portion 24 of dome 12. The symmetrical shape of dome 12 concentrates the force within cavity 82 of dome 12 in direction 22. This force tends to force dome 12 in the direction 22 by the bowing action described above.

At the same time, braces 14 are also forced in the direction 22 as dome 12 "pops out". The upward directed forces are transmitted to pins 70 by braces 14 via head portions 72. As long as the force against the dome and braces is in the direction 22, then pins 70 will be forced in the same direction 22 and therefore will be axially translated upwardly out of apertures 64 and 68. The retaining force due to grommets 76 is made sufficiently less than the load requirements set to release the dome 12 and braces 14 in response to an explosion.

By aligning all of the pins 70 in parallel with the given direction 22, the dome 12 and braces 14 will become disengaged from curb assembly 16 only when the force applied to the dome and brace assembly is in direction 22. A force in any other direction will tend to cock the dome brace structure and pins against apertures 64 and 68 jamming the pins in the apertures in a clutch-like action and prevent the disengagement of the pins 70 from the apertures 64 and 68. As a result, a small pressure differential existing between the exterior ambient and cavity 82, as little as 5 lbs. per sq. ft. and ranging upwardly to about 40 lbs. per sq. ft., will dislodge braces 14, dome 12 and pins 70 in response to a force that has a resultant direction 22. An asymmetrical force such as wind, flying debris, or accidental lifting imposed on dome 12 in response to a pressure differential will cause a tilting of the dome and brace structure with respect to the curb assembly 16 and a wedging of the pins 70 to member 34 and, therefore, no disengagement of the dome will take place.

In the same context, an asymmetrical loading force introduced by winds or by a person attempting to lift the dome structure off the roof at one corner thereof will cause a tilting action on the dome structure wedging the pins 70 in the corresponding apertures of curb assembly 16 and locking the dome assembly comprising dome 12, braces 14 and pins 70 to the curb assembly 16. Suitable alarm means, not shown, may be connected to this dome assembly to indicate whenever a portion of the dome assembly is disengaged from its normal position.

It will thus be appreciated that a dome suitable for transmitting light in a skylight application on a building roof or wall is simply and easily assembled to the roof by way of a plurality of elongated pins which tend to release the dome from the roof only in response to an explosion force occurring in a predetermined direction. It should be appreciated that many different arrangements of symmetrical dome structures and accompanying pins 70 may be arranged in accordance with the present invention. While flange portion 26 is shown locked in recess 63, it should be understood that the extended inward portion 60 of leg 50 need not extend beyond upstanding wall 58 so as to permit flange portion 26 to be freely exposed to the ambient. The extended end, inward portion 60, serves more as a protective medium against ambient weather conditions than as a restraining device for dome 12. Restraint provided by extended portion 60 is incidental and provides added security to the structure from accidental dislodgement. Further the depth that flange portion 26 extends into channel 63 will determine the flexing forces necessary to flex and dislodge dome 12. The greater the depth the greater this force. Additional factors in determining the flexing forces are, of course, the type and thickness of the material of dome 12. Pins 70 may also be secured directly through flange portions 26 without the need for braces 14 in a particular embodiment, in this instance, portion 60 would be omitted.

What is claimed is:

1. A building explosion venting apparatus for enclosing an explosion vent opening comprising:

a curb defining said opening and having a plurality of pin receiving apertures spaced in a predetermined array, a flexible thermoplastic skylight sheet member releaseably secured to said curb for enclosing said opening, said curb and sheet member being arranged for the release of said sheet member from said curb when said sheet member is forced in a given direction toward the building exterior by an explosion occurring within the building, a rigid brace member disposed across said opening, said sheet member being disposed between said brace member and the building interior, said brace member including a portion juxtaposed with said apertures, and a plurality of elongated pins extending from said brace member portion in a direction opposite said given direction and disposed in said given array in slideable engagement with said pin receiving apertures for releasing upon the occurrence of said explosion, said apertures and said pins being arranged to jam said pins in said apertures when said brace member receives a force in a direction different than said given direction thereby preventing the release of said sheet member in the presence of an ambient force in said different direction.

2. The apparatus of claim 1, further including releasable fastening means coupled to said pins, said curb being disposed between said releaseable fastening means and said brace member.

* * * * *